United States Patent [19]

Rogers

[11] 4,364,806

[45] Dec. 21, 1982

[54] GAS ELECTRODE SHUTDOWN PROCEDURE

[75] Inventor: Douglas K. Rogers, Painesville, Ohio

[73] Assignee: Diamond Shamrock Corporation, Dallas, Tex.

[21] Appl. No.: 261,774

[22] Filed: May 8, 1981

[51] Int. Cl.[3] ..... C25B 1/34; C25B 11/08; C25B 11/12

[52] U.S. Cl. ..... 204/98; 204/128; 204/265; 204/266; 204/294

[58] Field of Search ..... 204/98, 128, 265, 266, 204/294

[56] References Cited

U.S. PATENT DOCUMENTS 4,035,255 7/1977 Gritzner ..... 204/265
4,217,187 8/1980 Tufts et al. ..... 204/98
4,221,644 9/1980 LaBarre ..... 204/98
4,299,673 11/1981 Broniewski ..... 204/98

*Primary Examiner*—R. L. Andrews
*Attorney, Agent, or Firm*—John P. Hazzard; Woodrow W. Ban

[57] ABSTRACT

This disclosure is directed to a shutdown procedure for use in gas electrodes, e.g., oxygen (air) cathodes, which comprises imposing a nitrogen purge on the cell containing said electrode upon power shutdown and maintaining this nitrogen atmosphere (blanket) during the period of the shutdown. It has been discovered that the use of this procedure enables maintaining of the low voltage operation achieved prior to power shutdown upon restart of the cell when the power has been restored.

8 Claims, 1 Drawing Figure

GAS ELECTRODE SHUTDOWN PROCEDURE

BACKGROUND OF THE INVENTION AND PRIOR ART

Within the field of electrochemistry, there is a well-known type of an electrolytic cell known as a chlor-alkali cell. Basically this is a cell wherein chlorine gas and caustic soda, viz., sodium hydroxide, are produced by passing an electric current through a concentrated salt (brine) solution containing sodium chloride and water. A large portion of the chlorine and caustic soda for the chemical and plastics industries is produced in chlor-alkali cells. The cathodes employed in such chlor-alkali cells are subjected to the corrosive environment of the caustic soda.

Such cells are divided by a separator into anode and cathode compartments. The separator characteristically can be a substantially hydraulically impermeable membrane, e.g., a hydraulically impermeable cation exchange membrane, such as the commercially available NAFION manufactured by the E. I. du Pont de Nemours & Company. Alternatively, the separator can be a porous diaphragm, e.g., asbestos, which can be in the form of vacuum deposited fibers or asbestos paper sheet as are well known in the art. The anode can be a valve metal, e.g., titanium, provided with a noble metal coating to yield what is known in the art as a dimensionally stable anode. One of the unwanted by-products present in a chlor-alkali cell is hydrogen which forms at the cell cathode. This hydrogen increases the power requirement for the overall electrochemical process, and eliminating its formation is one of the desired results in chlor-alkali cell operation.

Fairly recently, attention has been directed in chlor-alkali cell technology to various forms of oxygen (air) cathodes. Such cathodes can result in significant savings in the cost of electrical energy employed to operate chlor-alkali cells. Estimates indicate that there is a theoretical savings of about 25 percent of the total electrical energy required to operate chlor-alkali cells provided that the formation of hydrogen at the cathode can be prevented. In other words, about 25 percent of the electrical energy employed in a chlor-alkali cell is used to form hydrogen at the cathode. Hence, the prevention of hydrogen formation by oxygen reduction at the cathode results in significant savings in the cost of electrical power. This is the major benefit of and purpose for oxygen (air) cathodes.

One problem observed with oxygen (air) cathodes was that when the electric power was shut off, e.g., due to a power outage or due to shutdown of a cell for repair or replacement of a component therein, the operating potential, or operating polarization, increased upon restart beyond the previous operating levels. This resulted in poorer performance, premature cathode failure and increased in the cost of operating and maintaining such cells. The above disadvantages were encountered upon startup of the oyxgen cathodes despite the fact that there was no extraneous change in the operating conditions upon the startup of the cell, viz., the same oxygen cathode was used, the same anode was used, the same anolyte was used, the same catholyte was used and the same oxygen-containing gas, e.g., oxygen or oxygen from which the carbon dioxide had been removed, were employed upon startup. Moreover, the same undesirable increase in operating voltage on restart was noted regardless of whether the cathode was operating on $CO_2$-free air or oxygen.

U.S. Pat. No. 4,221,644 to Ronald L. LaBarre is directed to air-depolarized chlor-alkali cell operation methods which are stated to maximize the power efficiency available from such oxygen electrodes while minimizing the voltage necessary to operate such oxygen electrodes. The methods set forth include control of the pressure of the air feed side of the oyxgen electrode, control of the total flow of the air feed side, the humidification of the air feed side of the oxygen electrode and the elimination of $CO_2$ from the air feed to the oxygen electrode to increase the lifetime of such electrodes as applied to chlor-alkali electrolytic cells. U.S. Pat. No. 4,221,644 is not concerned with how to treat an oxygen (air) cathode during a shutdown, whether by accidental or intentional means. At column 10, lines 46–62 of this LaBarre patent, it is stated that the presence of nitrogen in the air creates problems within the oxygen cathode since it acts as a diluent to thereby decrease the concentration of the oxygen present within the oxygen compartment 24 of the LaBarre electrolytic cell 12. LaBarre states that the nitrogen molecules enter the pores of the cathode 18 and must be diffused back out of the pores since they are not used in the reaction. It is stated that this causes a lack of activity within the porous catalytic areas of oxygen cathode 18 such as to reduce the power efficiency possible and increase the voltage necessary for the operation of such a cell. It is additionally stated that this condition may be reduced to a minimum by increasing the total flow so as to provide ample oxygen supply to the oxygen compartment 24, thus reducing to a minimum the voltage necessary to operate the cell while increasing to a maximum the possible power efficiency from such an electrolytic cell 12.

In view of this statement in the LaBarre patent concerning the result of oxygen cathode exposure to progressively greater relative concentrations of nitrogen as being detrimental and raising the operating voltage requirement of such cells, the discovery of the present invention is truly surprising. The present inventor has discovered that by imposing a nitrogen purge on the cell upon shutdown of the electric power, whether due to a power outage or due to an intentional shutdown, and maintaining the nitrogen during the entire period of the shutdown, it is possible to regain the low voltage of operation which was seen in the cell prior to the shutdown.

DETAILED DESCRIPTION OF THE INVENTION

Figure 1:
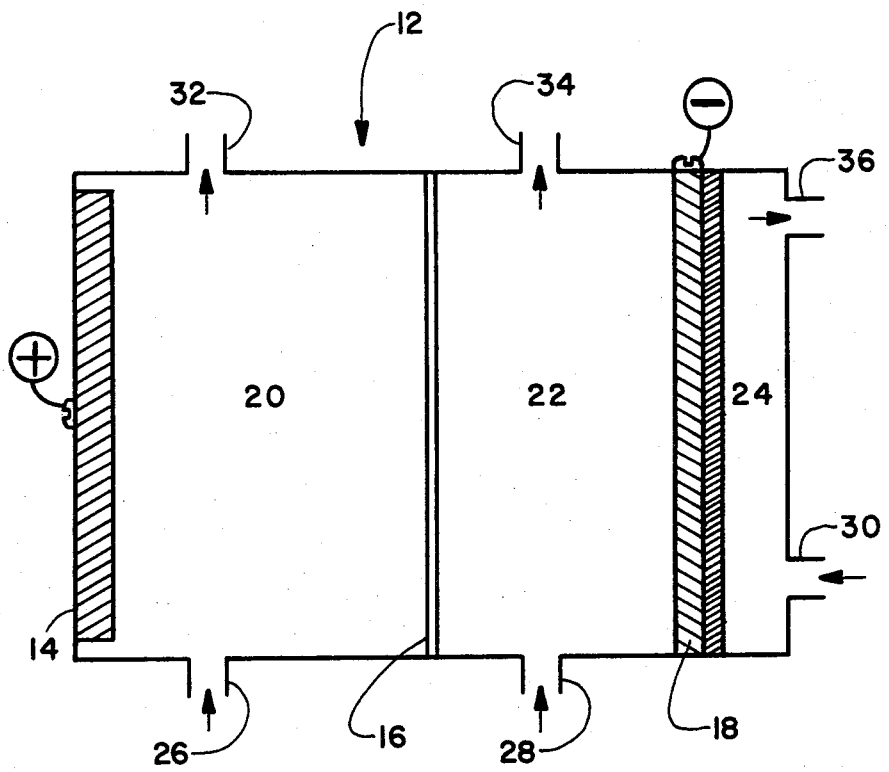

The present invention is directed to a process for treatment of a gas electrode, particularly oxygen (air) cathodes in an electrolytic cell, e.g., a chlor-alkali cell, a metal-air battery, etc., by imposing a nitrogen purge upon shutdown of current and power to the cell and thereafter maintaining nitrogen upon the oxygen (air) cathode or other gas electrode, for the duration of the shutdown period. The cell can then be restarted on the same type of oxygen-containing gas feed, whether it be pure oxygen or air from which the carbon dioxide has been removed, without suffering any significant loss in its desirably low operating potential, cathode electrical efficiency or catalytic efficiency and assisting the conduct of the reaction desired.

Prior to the discovery of the present invention, the oxygen (air) cathode, at the point of power interuption, would appear to become more anodic, producing what was presumed to be a catalyst dissolution rate increase. While the present invention is not dependent upon any theory as to the operation thereof, it can be theorized that upon shutdown or power loss, and replacement of the air or oxygen feed with nitrogen, there results a more cathodic potential at the cathode, due to the lack of reducible oxygen. Under these circumstances, the platinum catalyst is less susceptible to reactions which tend to dissolve it at the high cathodic potentials in concentrated caustic, e.g., sodium hydroxide, for example, in a chlor-alkali cell. Since there is no oxygen available to promote the oxidation of the carbon contained in the oxygen (air) cathode, the positive pressure of the nitrogen stream tends to prevent massive flooding of the reactive zones within the cathode structure. All of these forces, or some of them, may theoretically enable the electrolytic system to continue at previous performance voltage levels upon restart of the cell when the gas electrode shutdown procedure of this invention is employed.

Regardless of the applicable theoretical considerations, the plain fact of the matter is that exercise of the present invention as a gas electrode shutdown procedure enables the previously attained lower voltage operation to be resumed upon restart.

Basic Cell Components

The invention will be understood in further detail in respect of the sole FIGURE of the drawing. As indicated in the drawing, electrolytic cell 12 is comprised of anode 14, cathode 18 and separator 16 dividing the cell into anode compartment 20 and cathode compartment 22. To the right of cathode compartment 22 is the oxygen (air) compartment 24 having the oxygen (air) inlet 30 and a corresponding outlet 36 for the oxygen depleted effluent gas. Anolyte, e.g., a sodium chloride (brine) aqueous solution, is introduced through anode inlet 26 and spent anolyte liquor is removed via outlet 32. Similarly, water and caustic are introduced into the cell via catholyte inlet 28 and spent catholyte liquor is removed through outlet 34. Of course, there is provided a foundation for the cell (not shown) adequate to permit a plurality of such electrolytic cells 12 to be arranged in correct alignment in the form of a bank of electrolytic cells for production purposes.

The cell 12 itself can be manufactured from various materials, either metallic or plastic in nature, as long as these materials resist the corrosive surroundings of the material which with they are in contact and the temperature characteristics present during the operation of the cell. Hence, the anode compartment of a chlor-alkali cell must be resistant to chlorine, and the cathode compartment must be resistant to the caustic, viz., sodium hydroxide, which will be present within this compartment. Such materials generally include, but are not necessarily limited to, metallic materials such as steel, nickel, titanium and other valve metals in addition to plastics such as polyvinyl chloride, polyethylene, polypropylene, fiberglass, resin-impregnated fiberglass and other materials too numerous to mention. The valve metals include aluminum, molybdenum, niobium, titanium, tungsten, zirconium and alloys thereof.

The separator 16 can be of the diaphragm or membrane variety. The separator materials set forth in U.S. Pat. No. 4,221,644 can be employed in accordance with the process of this invention. Thus the separator 16 as shown in the drawing can be of the substantially hydraulically impermeable cation exchange membrane variety. According to a preferred embodiment of this invention, the separator 16 is a polymeric material marketed by the E. I. duPont de Nemours and Company under the trademark NAFION.

The Electrodes, Themselves

The present invention and its benefits are applicable to a wide variety of oxygen cathodes, esp., those containing an active layer, a wetproofing (backing) layer and a current distributor. Preferably, such oxygen (air) cathodes 18 contain these 3 components in a laminated and/or laminated/sintered electrode.

According to one preferred embodiment of this invention, oxygen cathode 18 is of the type described and claimed in U.S. patent application Ser. No. 202,585 entitled "Three-layer Laminated Matrix Electrode" filed on Oct. 31, 1980, in the name of Frank Solomon. The disclosure of this application is incorporated herein by reference. Such three-layer laminated matrix electrodes are laminates of a polytetrafluoroethylene (PTFE)-containing wetproofing layer laminated on one side to a matrix active layer comprising active carbon particles (catalyzed or uncatalyzed) present within an unsintered network (matrix) of fibrillated carbon black-polytetrafluoroethylene. The opposite surface of the active layer is liminated to a current distributor of the type more fully described hereinbelow.

Wetproofing Layer

The PTFE-containing wetproofing layer can be prepared by a single pass process, viz., passing it once through heated rollers, and in the final laminate is comprised primarily of PTFE with pores evenly distributed therethrough. Such PTFE-containing wetproofing layers can be prepared as follows:

Two hundred cubic centimeters of isopropyl alcohol were poured into an "Osterizer" blender. Then 49 grams of "duPont 6A" polytetrafluoroethylene were placed in the blender and the PTFE (alcohol dispersion) was blended at the "blend" position for approximately one minute. The resulting slurry had a thick pasty consistency. Then another 100 cc of isopropyl alcohol were added in the blender and the mixture was blended (again at the "blend" position) for an additional two minutes.

Then 91 grams of particulate sodium carbonate in isopropanol (ball milled and having an average particle size of approximately 3.5 microns, as determined by a Fisher Sub Sieve Sizer) were added to the blender. This PTFE-sodium carbonate mixture was then blended at the "blend" position in the "Osterizer" blender for 3 minutes followed by a higher speed blending at the "liquefying" position for an additional one minute. The resulting PTFE-sodium carbonate slurry was then poured from the blender onto a Buchner funnel and filtered and then placed in an oven at 80° C. where it was dried for 3 hours resulting in 136.2 grams yield of PTFE-sodium carbonate mixture. This mixture contained approximately 35 weight parts of PTFE and 65 weight parts of sodium carbonate.

This mixture was mildly fibrillated in a Brabender Prep Center with attached sigma mixer as described above.

After fibrillating, which compresses and greatly attenuates the PTFE, the fibrillated material is chopped to a fine dry powder using a coffee blender, i.e., Type Varco, Inc. Model 228.1.00 made in France. Chopping to the desired extent takes from about 5 to 10 seconds because the mix is friable. The extent of chopping can be varied as long as the material is finely chopped.

The chopped PTFE - $Na_2CO_3$ mixed is fed to six inch diameter chrome-plated steel rolls heated to about 80° C. Typically, these rolls are set at a gap of 0.008 inch (8 mils) for this operation. The sheets are formed directly in one pass and are ready for use as backing layers in forming electrodes, e.g., oxygen cathodes, with no further processing beyond cutting, trimming to size and the like.

Active Layer

The matrix active layer to which the above wetproofing layer can be secured during lamination is one comprised of catalyzed or uncatalyzed active carbon particles present within an unsintered network (matrix) of fibrillated carbon black-polytetrafluoroethylene. This matrix active layer can contain silver as a catalyst or a catalyst enhancer, the active carbon particles, per se, having catalytic activity for the reaction taking place within the oxygen (air) cathode 18. Such silver-catalyzed matrix active layers can be prepared as follows:

Commerically available ball milled "RB carbon" was found to have an ash content of approximately 12 percent as received. This "RB carbon" was treated in 38 percent KOH for 16 hours at 115° C. and found to contain 5.6 percent ash content after a subsequent furnace operation. The alkali treated "RB carbon" was then treated (immersed) for 16 hours at room temperature in 1:1 aqueous hydrochloric acid (20 percent concentration). The resulting ash content had been reduced to 2.8 percent. "RB carbon," deashed as above, was silvered in accordance with the following procedure:

Twenty (20 g) grams of deashed "RB carbon" were soaked in 500 ml of 0.161 N (normal) aqueous $AgNO_3$ with stirring for two hours; the excess solution was filtered off to obtain a filter cake. A retrieved filtrate was 460 ml of 0.124 N $AgNO_3$. The filter cake was rapidly stirred into an 85° C. alkaline formaldehyde solution, prepared using 300 cc (cubic centimeters) water, and 30 cc of 30 percent aqueous NaOH and 22 cc of 37 percent aqueous $CH_2O$, to ppt. Ag in the pores of the active carbon.

Calculation indicated that 79 percent of the 2.58 grams of retained silver in the catalyst was derived from adsorbed silver nitrate.

Separately, "Shawinigan Black," a commercially avaiable acetylene carbon black, was teflonated with "Teflon 30" (duPont polytetrafluoroethylene dispersion), using an ultrasonic generator to obtain intimate mixture. 7.2 grams of the dried carbon black/PTFE mix was high speed chopped, spread in a dish, and then heat treated at 525° F. for 20 minutes. Upon removal and cooling, it was once again high speed chopped, this time for 10 seconds. Then 18 grams of the classified silvered active carbon was added to the 7.2 grams of carbon black-Teflon mix, high speed chopped for 15 seconds, and placed into a fiberizing (fibrillating) apparatus. The apparatus used for fiberizing consists of a Brabender Prep Center, Model D101, with an attached measuring head REO-6 on the Brabender Prep Center and medium shear blades were used. The mixture was added to the cavity of the mixer using 50 cc of a 30/70 (by volume) mixture of isopropyl alcohol in water as a lubricant to aid in fibrillating. The mixer was then run for 5 minutes at 30 rpm at 50° C., after which the material was removed as a fibrous coherent mass. This mass was then oven dried in a vacuum oven and was high speed chopped in preparation for rolling.

The chopped particulate material was then passed through a rolling mill, a Bolling rubber mill. The resulting matrix active layer sheet had an area density of 22.6 milligrams per square centimeter and was ready for lamination.

A matrix active layer containing platinum catalyzed active carbon particles can be prepared in accordance with the procedure described above for deposition of silver catalyst except that platinum was deposited on the deashed active ("RB") carbon instead of silver. The 10 to 20 micron classified deashed "RB" carbon had platinum applied thereto in accordance with the procedure described in U.S. Pat. No. 4,044,193 using $H_3Pt(SO_3)_2OH$ to deposit one weight part platinum per 34 weight parts of deashed active carbon. After fibrillation and upon rolling, the area density of the active layer was determined to be 22.2 m/cm$^2$. This platinum-catalyzed matrix active layer was then ready for lamination.

Current Distributor

As noted above, the aforementioned laminated oxygen cathodes contain a current distributor. The current distributor can be any electroconductive, woven or nonwoven, symmetrical or asymmetric, wire mesh or grid. When the current distributor is asymmetric, it is preferably one which has an asymmetric woven wire mesh wherein a greater number of wires is oriented in a direction perpendicular to the major current distributor, viz., the current feeder bars and spanning the narrow part of the rectangular electrode. A smaller number of wire strands is arranged in the other, viz., horizontal, direction. In other words, in a preferred embodiment involving the use of an asymmetric woven wire mesh current distributor, the major current distributor supplies current to the periphery of the electrode. The majority of the current is supplied across the short dimension (vertical) in cases involving rectangular electrodes. Hence such asymmetric woven wire mesh current distributors have more fill wires than warp wires. Although any electroconductive material can be employed in the current distributor, preferably the wires of the mesh material are selected from the group consisting of nickel, nickel-plated copper, silver-plated nickel and silver-plated, nickel-plated copper, viz., copper wires that are first plated with nickel and then over plated with silver upon the nickel.

Such asymmetric woven wire mesh current distributors characteristically contain about twice as many wires in the vertical direction as are contained in the horizontal direction. Such a configuration reflects savings of approximately 50 percent in weaving time and 25 percent in material costs. The asymmetric woven wire mesh current distributors referred to hereinabove are described and claimed in U.S. patent application Ser. No. 202,574 filed in the name of Frank Solomon on Oct. 31, 1980, and entitled "Asymmetric Current Distributor." The disclosure of this application is incorporated herein by reference.

Alternatively the current distributor layer can be of the plaque type, viz., a comparatively compact yet porous layer, characteristically having porosities ranging from about 40 to 60 percent and made of copper, nickel, silver, titanium, iron, etc.

Plaque current distributor layers are usually from 10 to 30 mils in thickness and are well known in the art of electrochemistry.

Instead of a plaque-type current distributor, the electrodes of this invention can contain a symmetrical woven wire mesh distributor or one of the nonwoven or wire grid type, either symmetrical or asymmetric.

Oxygen Cathode Variations

The three-layer laminated matrix electrodes, the use of which is contemplated according to the process herein, can be laminated with heat and pressure. These laminates usually have the active layer centrally located, viz., positioned in the middle between the PTFE-containing wetproofing layer on the one side and the current distributor layer on the other side. The three layers arranged as described are laminated at temperatures ranging from about 100° to 130° C. and pressures of 0.5 to 10 T/in$^2$ followed by removal from the pressing device, usually a hydraulic press. The laminates are preferably then subjected to a hot soaking step(s) in ethylene glycol or equivalent polyol to enhance the removal of the pore-forming agent(s) employed to form the aforementioned backing (wetproofing) layer and any bulking and/or pore-forming agent optionally included in the active layer, upon subsequent washing(s) with water.

In accordance with one preferred embodiment of this invention, a three-layer laminated matrix electrode is formed utilizing the PTFE-containing wetproofing layer prepared as described above laminated to a current distributor and respective matrix active layers which were platinum-catalyzed and silver-catalyzed in a manner set forth above. The current distributor employed was a 0.005 inch diameter nickel woven wire mesh having a 0.0003 inch thick silver plating and a 50×50 woven strand arrangement. The lamination was performed in a hydraulic press at 100° to 130° C. using pressures of 4 to 8.5 T/in$^2$ for several minutes. These laminates were then hot soaked in ethylene glycol at 75° C. for 20 minutes before water washing at 65° C. for 18 hours followed by drying. The laminates were then prepared for use as an oxygen (air) cathode in accordance with the blow-through oxygen (air) pressure operation in accordance with this invention.

According to another preferred embodiment of this invention, three-layer laminated oxygen (air) cathodes are prepared utilizing the PTFE-containing wetproofing layer prepared as described above in conjunction with a current distributor of the type as described above and an active layer or sheet containing from about 60 to about 85 weight percent active carbon particles, the remainder being unsintered, fibrillated polytetrafluoroethylene in intimate admixture with said active carbon. Such active layer can be prepared as follows: 100 grams of RB active carbon were ball milled for 4 hours in water. This carbon was subsequently treated with 1600 ml or 38 percent NaOH for an hour at 110° to 120° C. with stirring. It was then filtered and washed. This treatment was repeated three times, then followed by a room temperature overnight soak in 1:1 HCl and a final washing and drying in air at 110° C. 20 g of carbon, so prepared, were then platinized in a ratio of 28 parts of carbon to one part Pt, using $H_3Pt(SO_3)_2OH$ in accordance with the procedure of U.S. Pat. No. 4,044,193. Twenty (20) grams of carbon were suspended in 333 ml of water and 357 ml of $H_3Pt(SO_3)_2OH$ (200 g Pt/liter solution) were added and then decomposed to hydrous platinum oxide by the addition of 8.6 ml of 35 percent $H_2O_2$. After filtering, washing and air drying at 140° C., the catalyzed carbon was ready for the next step, "Teflonation." 20 g of catalyzed carbon were suspended in 300 ml water with stirring. 8.4 ml of "Teflon 30" dispersion were separately diluted in 300 ml of water. The diluted Teflon 30 dispersion was slowly added to the catalyzed carbon suspension. After coagulation, the mixture was washed and dried. The mix was weighed and was found to be 25 g. The 25 g mix was then fibrillated by shear blending in the Brabender Prep Center, in measuring head type REO-6 using medium shear cams or blades. The mix was lubricated with 38 cc of 30 percent isopropanol in water and was kneaded for 2½ minutes at 25 rpm. It was then vacuum dried. 3 g of mix were chopped 30 seconds in a Varco Mod. 228-1 coffee grinder and then rolled at 75° C. through 6 inch diameter rolls at a roll separation of 0.007 inch. The rolled sheet was 0.010 inch thick. At this point, the sheet was ready for incorporation into an electrode.

Alternatively the active layer can be prepared utilizing silver-catalyzed active carbon. The procedure described above for preparation of the platinum-catalyzed active layer is followed up to the point of applying the catalyst. To catalyze the carbon with silver, 16.7 grams of carbon were suspended in 396 milliliters of water containing 21.3 grams of silver nitrate and stirred for two hours. The carbon was then filtered to remove all excess liquid and the filter cake was then slurried in a previously prepared solution of 250 milliliters of water, 25 milliliters of a 30 percent sodium hydroxide and 18.3 milliliters of a 37 percent formaldehyde solution and was held at 85° C. for 60 minutes with continuous stirring. The resulting silvered carbon was then washed and dried, and processed to sheet material following the procedure indicated above utilizing the same sequence with only minor variations. The carbon to silver ratio was 5:1.

The active layers prepared as described above to contain either the platinum or silver catalyst can then be laminated with the active layer positioned in the middle between the PTFE backing layer on the one side and the current distributor layer on the other side. These three layers arranged as described were laminated using heat and pressure at temperatures ranging from about 100° to about 130° C. and pressures of 0.5 to 10 T/in$^2$ followed by removal from the press. These laminates were then subjected to a hot soaking step in ethylene glycol followed by a subsequent washing(s) with water.

Specifically the platinum-catalyzed and silver-catalyzed active layers prepared as described above to contain from about 60 to about 85 weight percent active carbon particles, the remainder being unsintered, fibrillated polytetrafluoroethylene in intimate admixture therewith were prepared by laminating a current distributor, silver plated 50×50×0.005 nickel wire cloth and a hydrophobic gas diffusion wetproofing layer containing 65 weight percent sodium carbonate and 35 weight percent PTFE to each of the aforesaid active layer sheets with the current distributor being in contact with one surface of the active layer and the opposite surface in contact with the PTFE wetproofing layer prepared as described above. The lamination was done in a hydraulic press at 8.5 T/in$^2$ pressure and 115° C. and was followed by hot soaking in ethylene glycol as described above followed by water washing (to remove pore former) and drying. These laminates were then ready for utilization as oxygen (air) cathodes 18 for operation by the blow-through procedure in accordance with this invention.

According to yet another embodiment of this invention, the oxygen (air) cathode 18 is a non-bleeding gas electrode of the type described and claimed in U.S. patent application Ser. No. 202,564 entitled "Non-bleeding Electrode" and filed in the name of Frank Solomon on Oct. 31, 1980. Such electrodes are comprised of a hydrophobic, polytetrafluoroethylene-containing porous backing layer, an active layer containing high surface area carbon particles wherein said active layer has pores sufficiently large to relieve internal liquid pressures therein and a current distributor. Such an oxygen (air) electrode can be made by lamination in the manners described above or lamination followed by sintering. Typically such laminated, sintered electrodes are prepared as follows: Steam treated "XC-72R" high surface area carbon black was platinized in accordance with the procedure of U.S. Pat. No. 4,004,193 using $H_3Pt(SO_3)_2OH$ to deposit approximately 5 percent platinum on the carbon black. This platinum catalyzed carbon black was then teflonated in a manner described above using an ultrasonic generator. The teflonated platinized carbon black was then mixed with the equivalent of what amounts to 25 weight percent of the total active layer of ball milled sodium carbonate having an average particle size of about 5 microns. The wet mix was dried, extracted overnight with chloroform and then the active layers were formed by deposition on a layer of sodium chloride on filter paper. Each active layer contained approximately 285 milligrams of said active layer mix. The active layers were then placed in the middle between a silver-plated nickel current distributor (described in more detail hereinabove) having a 50×50 woven wire mesh and the PTFE-containing backing layer to form a sandwich assembly. Both assemblies were respectively consolidated by laminating at 112° C. at a pressure of 5 T/in$^2$ in a hydraulic press. On removal, the assemblies were soaked in hot ethylene glycol (75° C.) for 20 minutes and then washed in hot water (to remove the pore former) and dried. One laminated electrode was then sintered in argon under a flat weight at 675° F. (357° C.) for 40 minutes. The other was not sintered after lamination. Both such oxygen cathodes can be subjected to the blow-through process of this invention to result in lower operating voltage.

The present invention will be illustrated further in the examples which follow. In these examples, all parts, percents and ratios are by weight unless otherwise indicated.

EXAMPLE 1

A one square inch test cathode was cut from a larger laminated sheet prepared as follows:

A porous, self-sustaining, coherent, unsintered, uniaxially oriented wetproofing layer, containing 65 percent $Na_2CO_3$ and 35 percent PTFE, was made in accordance with the one pass procedure set forth above using "duPont 6A" PTFE dispersion.

An active layer of "Teflonated," fiberized (fibrillated), platinized, RBDA active carbon (RB carbon previously deashed by alkali then acid treatment as described above) was prepared to contain 76.2 percent RBDA carbon, 3.8 percent platinum (applied by the method of U.S. Pat. No. 4,044,193) and 20 percent polytetrafluoroethylene ("PTFE 30"). After platinizing, the RBDA particles were "Teflonated" using "duPont PTFE 30" dispersion, fiberized for approximately 2.5 minutes using the Type Varco blender at 15 rpm into sheet form and then assembled as the central layer with the single pass PTFE sheet wetproofing layer on one side and a current distributor on the other side. The current distributor was a 30×30 mesh of 0.006 inch diameter nickel wire having a 0.0003 inch thick silver plating. The assembly was pressed at 8.5 T/in$^2$ and 115° C. for 3 minutes to yield at laminated cathode.

This air cathode was started on air at a current density of 155 mA/cm$^2$ and 81° C. at low pressure. Upon adjustment of operating variables to standard operating condition at 155 mA/cm$^2$, 85° C., and higher pressure, performance was observed to be about −100 mV voltage vs. Hg/HgO reference in the same NaOH concentration electrolyte. This performance continued for 5 days at the −100 to −140 mV level unit all power was cut for 3 hours.

Air remained in contact with the cathode. Electrolyte temperature dropped to room temperature. Voltage declined to that value at open circuit.

Upon restart, the above-described startup method was repeated with air feed, and when adjusted to the same operating conditions at performance of about −210 mV vs. Hg/HgO reference was observed. This was 70 mV worse performance. This poorer performance continued to decline for the next 20 days until the run was terminated.

This represents what occurred prior to the present invention when an oxygen cathode previously operating on air was subject to a power outage then restarted directly on air.

EXAMPLE 2

A one square inch test cathode was cut from a larger laminated sheet prepared as follows:

The backing (wetproofing) layer was prepared the same as described above in Example 1.

An active layer of "Teflonated," fiberized, catalyzed RBDA carbon was prepared to contain 61.9 percent RBDA carbon, 2.1 percent platinum, 16 percent silver and 20 percent PTFE (using "PTFE 30"). The platinum was deposited using the method of U.S. Pat. No. 4,044,193. After platinizing, the silver was applied using a 0.161 N (normal) aqueous $AgNO_3$ solution with stirring for 2 hours. The excess solution was filtered off to obtain a filter cake. The filter cake was rapidly stirred into an 85° C. alkaline formaldehyde solution, prepared using 300 cc water, 30 cc of 30 percent aqueous NaOH and 22 cc of 37 percent aqueous formaldehyde to precipitate silver. The thus catalyzed RBDA carbon particles were then "Teflonated," fiberized and rolled into an active layer as in Example 1. This active layer was then laminated with the wetproofing layer using the current distributor of, and in accordance with, the procedure of Example 1 to prepare the laminated cathode.

This air cathode was operated at 155 mA/cm$^2$ current density, 85° C., using aqueous sodium hydroxide electrolyte, with air feed at 5 times the stoichiometric requirement and at elevated pressure for 55 days. On the 55th day, the cathode voltage was −319 mV vs. Hg/HgO reference in the same electrolyte.

Power was cut to the cell with simultaneous switchover to nitrogen feed instead of air, and the cell was allowed to cool to room temperature and remain under nitrogen blanket and in contact with electrolyte overnight.

Upon restart, one the cell resumed normal operating temperature and pressure, the cathode voltage was −320 mV vs. Hg/HgO. This is effectively the same performance as before shutdown which has not been the experience when nitrogen is not applied.

EXAMPLE 3

A one square inch test cathode was cut from a larger laminated sheet prepared as follows:

A porous, self-sustaining, coherent, unsintered, polyaxially oriented wetproofing layer of fibrillated PTFE was formed to contain 65 percent of ball milled $Na_2CO_3$ pore former and 35 percent PTFE (as an aqueous dispersion of PTFE coagulum, viz., duPont PTFE 42, coagulated into a floc by addition of isopropyl alcohol) by Sigma mixing same, chopping and rolling into sheet form by passing it several times through rollers, with folding and change of direction on each pass to result in a polyaxially oriented sheet. This sheet was then degreased, viz., the oil was extracted with "M-Clere D" (a commercial solvent) and heated at 300° C. for 20 minutes to prepare it for assembly.

An active layer of "Teflonated," fiberized (fibrillated), platinized, RBDA active carbon (RB carbon previously deashed by alkali then acid treatment as described above) was prepared to contain 71.0 percent RBDA carbon, 4.0 percent platinum (applied by the method of U.S. Pat. No. 4,044,193) and 25.0 percent PTFE (as "Teflon 30"). After platinizing, the RBDA particles were "Teflonated," fiberized, rolled into sheet form and then assembled as the central layer with the PTFE wetproofing layer on one side and a current distributor on the other side. The current distributor was a 30×30 mesh of 0.006 inch diameter nickel wire having a 0.0003 inch thick silver plating. The assembly was pressed at 8.5 T/in$^2$ and 115° C. for 3 minutes to yield a laminated cathode.

This cathode was started and was performing steadily at around −650 mV vs. Hg/HgO reference at 310 mA/cm$^2$ current density and 85° C. in aqueous sodium hydroxide with the air feed at 2.5 times the stoichiometric requirement and at elevated pressure.

Power was shut down and the cell was allowed to cool to room temperature with the cathode in contact with its electrolyte on one side and nitrogen instead of air on the other side. After 16 hours in this state, the cell was restarted and seen to have the same voltage upon resumption of all operating conditions.

EXAMPLE 4

A laminated cathode was formed as in Example 1 using the same PTFE wetproofing layer and active layer as in Example 1 but using a 60×58, 0.004 inch diameter nickel wire cloth having a 0.0003 inch thick silver plating as the current distributor.

This cathode was started and then run for 45 days at the following condition:

air feed @ 2.5×stoichiometric rate at elevated pressure

85° C. aqueous NaOH electrolyte 155 mA/cm$^2$ current density

Performance upon power shutdown was around −500 mV voltage vs. Hg/HgO reference in the same solution. Nitrogen was used to purge air from the air feed chamber and the cathode remained in contact with the electrolyte on one side and the nitrogen or the other overnight.

The next day the cell was reheated and fed with air under normal starting and cathode voltage performance was in the same −500 mV range.

What is claimed is:

1. In a gas electrode shutdown procedure where an electrode oxidizable when not protected by electrical polarity is operating on a given gas supply in an electrolytic cell at a given operating voltage and the cell is deprived of electrical power, the improvement comprising feeding nitrogen gas to said cell to establish a nitrogen atmosphere (blanket) therein and maintaining same for the duration of the power outage to said cell.

2. The improved procedure as in claim 1 wherein said electrode is an oxygen (air) cathode.

3. The improved procedure as in claim 2 wherein said gas is oxygen.

4. The improved procedure as in claim 2 wherein said gas is $CO_2$-free air.

5. The improved procedure as in claim 2 wherein said oxygen (air) cathode is a laminate of a wetproofing layer containing polytetrafluoroethylene particles, an active layer containing carbon particles and a current distributor.

6. The improved procedure as in claim 5 wherein said carbon particles contain a precious metal catalyst.

7. The improved procedure as in claim 6 wherein said precious metal comprises platinum.

8. The improved procedure as in claim 6 wherein said precious metal comprises silver.

* * * * *